US007438370B2

(12) United States Patent
Motominami et al.

(10) Patent No.: US 7,438,370 B2
(45) Date of Patent: Oct. 21, 2008

(54) DISPLAY CONTROL METHOD AND APPARATUS FOR PRINTER

(75) Inventors: Yoshihisa Motominami, Nagano-ken (JP); Hirotake Kitajima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 253 days.

(21) Appl. No.: 11/235,145

(22) Filed: Sep. 27, 2005

(65) Prior Publication Data

US 2006/0071952 A1 Apr. 6, 2006

(30) Foreign Application Priority Data

Sep. 27, 2004 (JP) ..... 2004-280626
Sep. 26, 2005 (JP) ..... 2005-277525

(51) Int. Cl.
*B41J 2/195* (2006.01)

(52) U.S. Cl. ..... 347/7; 347/5; 347/9

(58) Field of Classification Search ..... 347/7, 347/19, 86, 5, 9
See application file for complete search history.

(56) References Cited

U.S. PATENT DOCUMENTS 5,751,449 A * 5/1998 Nobuta ..... 358/498
6,513,891 B2 * 2/2003 Eida ..... 347/7
2003/0214542 A1 * 11/2003 Yoshida et al. ..... 347/7

FOREIGN PATENT DOCUMENTS

| | | | |
|---|---|---|---|
| JP | 10-129000 | A | 5/1998 |
| JP | 10-202913 | A | 8/1998 |
| JP | 10-226087 | A | 8/1998 |
| JP | 2002-361891 | A | 12/2002 |
| JP | 2003-063038 | A | 3/2003 |
| JP | 2003-072105 | A | 3/2003 |
| JP | 2003-205624 | A | 7/2003 |

* cited by examiner

*Primary Examiner*—Lam S Nguyen
(74) *Attorney, Agent, or Firm*—Sughrue Mion, PLLC

(57) ABSTRACT

A multifunction machine includes cartridge accommodation portions provided at different positions. Each of the accommodation portions accommodates multiple ink cartridges. If the ink remaining amount of at least one of the cartridges is smaller than a threshold value, a display control section determines that the cartridge requires replacement and operates a display to display an ink-end screen. The ink-end screen displays a message requiring the cartridge be replaced and information regarding the position of the accommodation portion corresponding to the cartridge requiring replacement.

22 Claims, 8 Drawing Sheets

DISPLAY CONTROL METHOD AND APPARATUS FOR PRINTER

CROSS-REFERENCE TO RELATED APPLICATIONS

This application is based upon and claims the benefit of priority from prior Japanese Patent Applications No. 2004-280626, filed on Sep. 27, 2004, and No. 2005-277525, filed on Sep. 26, 2005, the entire contents of which are incorporated herein by reference.

BACKGROUND OF THE INVENTION

The present invention relates to display control methods and apparatuses for printers, and, more particularly, to methods and apparatuses for displaying information regarding the position of a cartridge requiring replacement due to decrease of the amount of a recording agent retained in the cartridge.

As printers, inkjet types are generally used. An inkjet printer includes ink cartridges for retaining ink of different colors such as cyan, magenta, yellow, black, and the like. Each of the ink cartridges supplies the ink to corresponding nozzles, which eject the ink for printing. If the ink supply of any of the ink cartridges is completely depleted, the ink of the corresponding color cannot be used for printing. Thus, when any of the ink cartridges requires replacement due to decrease of the corresponding ink supply, the user needs to be informed of such information.

For this purpose, methods of monitoring the ink amount by means of a host computer have been proposed. More specifically, in one such method, the ink amount of each of the ink cartridges is displayed on a utility screen of a printer driver when the utility screen is first displayed on a display of the host computer. However, this method involves activation of the host computer, thus complicating user operation. To solve this problem, Japanese Laid-Open Patent Publication No. 2003-205624 describes a technique allowing the user to visibly acknowledge the ink amount of each ink cartridge with the ink cartridges maintained in the printer.

However, this technique requires each ink cartridge to be arranged at a position that ensures the visibility of the corresponding ink supply, thus restricting the component layout of the printer. Further, the printer using the technique has a visible interior, which may be aesthetically uncomfortable. The technique is thus difficult to actually apply.

Alternatively, requirement of the ink cartridge replacement may be informed through a display provided in a printer. However, some types of printers may include a plurality of cartridge accommodation portions. For example, in a printer having two cartridge accommodation portions, one of the accommodation portions accommodates cyan and magenta ink cartridges and the other accommodates yellow and black ink cartridges. In this case, even if the color of the ink cartridge requiring replacement is displayed on the display, the position of such ink cartridge is not acknowledgeable to the user, which is inconvenient for the user.

SUMMARY OF THE INVENTION

Accordingly, it is an objective of the present invention to provide a printer having a plurality of cartridge accommodation portions capable of informing the user of the position of an ink cartridge that requires replacement, without complicating the component layout of the printer or affecting the aesthetic appearance of the printer.

To achieve the foregoing and other objectives and in accordance with the purpose of the present invention, the invention provides a method for displaying information regarding cartridges installed in a printer on a display. The printer includes cartridge accommodation portions provided at different positions, each of the accommodation portions being capable of accommodating at least one of the cartridges retaining a recording agent. The method includes: detecting a remaining amount of the recording agent retained in each of the cartridges; and operating the display, when the remaining amount of the recording agent in at least one of the cartridges is smaller than a predetermined threshold value, to display position information of the cartridge accommodation portion that accommodates the cartridge in which the remaining amount of the recording agent is smaller than the threshold value.

The present invention also provides an apparatus for displaying information regarding cartridges installed in a printer on a display. The printer includes cartridge accommodation portions provided at different positions, each of the accommodation portions being capable of accommodating at least one of the cartridges retaining a recording agent. The apparatus includes a detector section and a display control section. The detector section detects a remaining amount of the recording agent retained in each of the cartridges. The display control section controls the display. When the remaining amount of the recording agent in at least one of the cartridges is smaller than a predetermined threshold value, the display control section operates the display to display position information of the cartridge accommodation portion that accommodates the cartridge in which the remaining amount of the recording agent is smaller than the threshold value.

Further, the present invention provides a printer having a plurality of cartridges, cartridge accommodation portions, a printing mechanism, a detector section, a display, and a display control section. The cartridges each retain a recording agent. The cartridge accommodation portions are provided at different positions in the printer. Each of the accommodation portions is capable of accommodating at least one of the cartridges. The printing mechanism performs printing using the recording agent in each of the cartridges. The detector section detects a remaining amount of the recording agent in each of the cartridges. The display control section controls the display. When the remaining amount of the recording agent in at least one of the cartridges is smaller than a predetermined threshold value, the display control section operates the display to display position information of the cartridge accommodation portion that accommodates the cartridge in which the remaining amount of the recording agent is smaller than the threshold value.

The present invention provides another a printer having a plurality of cartridges, cartridge accommodation portions, a printing mechanism, a detector section, a plurality of indicators, and a control section. The cartridges each retain a recording agent. The cartridge accommodation portions are provided at different positions in the printer. Each of the accommodation portions is capable of accommodating at least one of the cartridges. The printing mechanism performs printing using the recording agent in each of the cartridges. The detector section detects a remaining amount of the recording agent in each of the cartridges. The indicators are arranged at positions corresponding to the cartridge accommodation portions. The control section controls the indicators. When the remaining amount of the recording agent in at least one of the cartridges is smaller than a predetermined threshold value, the control section activates the indicator corresponding to the accommodation portion accommodating the cartridge in which the remaining amount of the recording agent is smaller than the threshold value.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment according to the present invention will now be described with reference to FIGS. 1 to 9.

Figure 1:
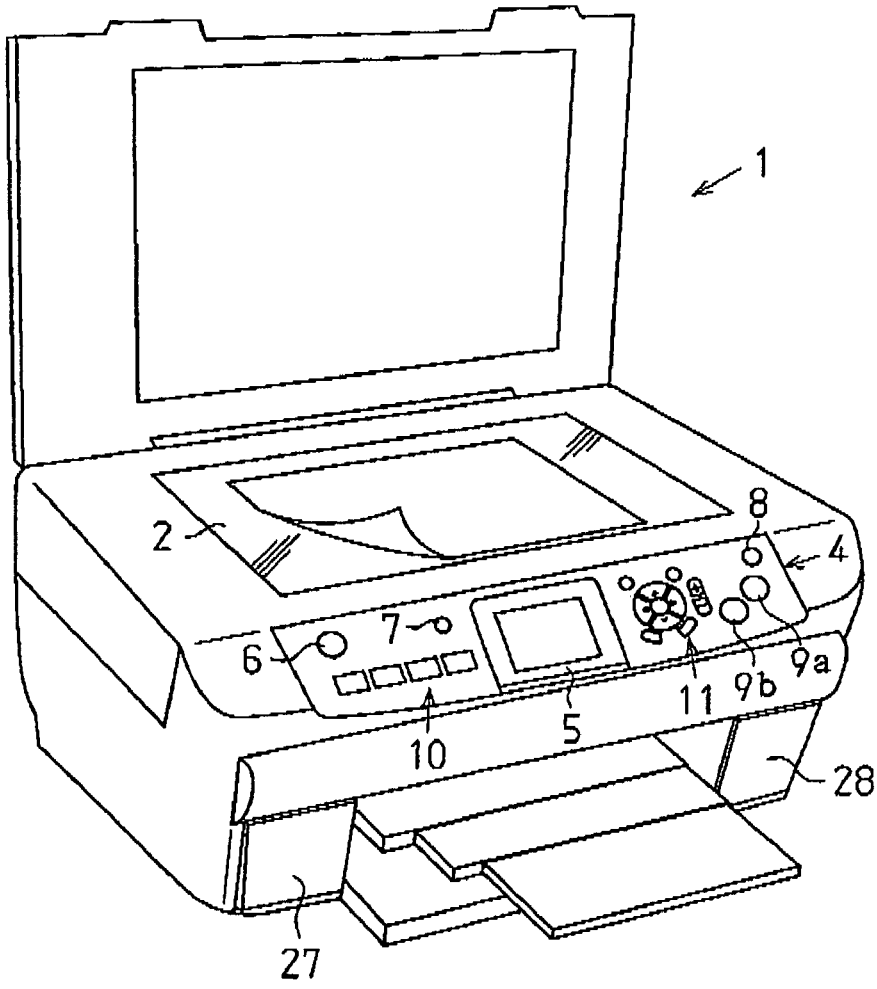
FIG. 1 is a perspective view showing a multifunction machine according to a first embodiment of the present invention.

FIG. 1 is a perspective view showing a multifunction machine (SPC) 1. The multifunction machine 1 functions as a scanner, a printer, and a copier. More specifically, as the scanner, the multifunction machine 1 reads (scans) an image from an object placed on a table 2 through a scanning mechanism 16 (FIG. 3), thus obtaining image data (scanned data). The data is then converted to digital data. The resulting data can be transmitted from the multifunction machine 1 to a host computer. As a printer, the multifunction machine 1 prints image data received from an external source (for example, printing data received from the host computer). As a copier, the multifunction machine 1 reads the image from the object through the scanning mechanism 16 and prints the obtained scanned data. In the first embodiment, a printer of the present invention is embodied as the multifunction machine 1.

The multifunction machine 1 reads image data from an external memory media 3 (for example, a memory card, see FIG. 3) connected to the body of the multifunction machine 1 and prints the data, in accordance with direct printing function. That is, the multifunction machine 1 includes a media reader (not shown) that can read the data from the external memory media 3. Also, the multifunction machine 1 stores image data from a certain external memory media 3 in a different external memory media 3 in accordance with backup function. For example, the multifunction machine 1 stores image data that has been read from a memory card through a media reader in a CD-R through a CD-R drive connected to the multifunction machine 1. Further, the multifunction machine 1 stores the image data that has been read by the scanning mechanism 16 in an external memory media 3 in accordance with scan-to-memory function.

Figure 2:
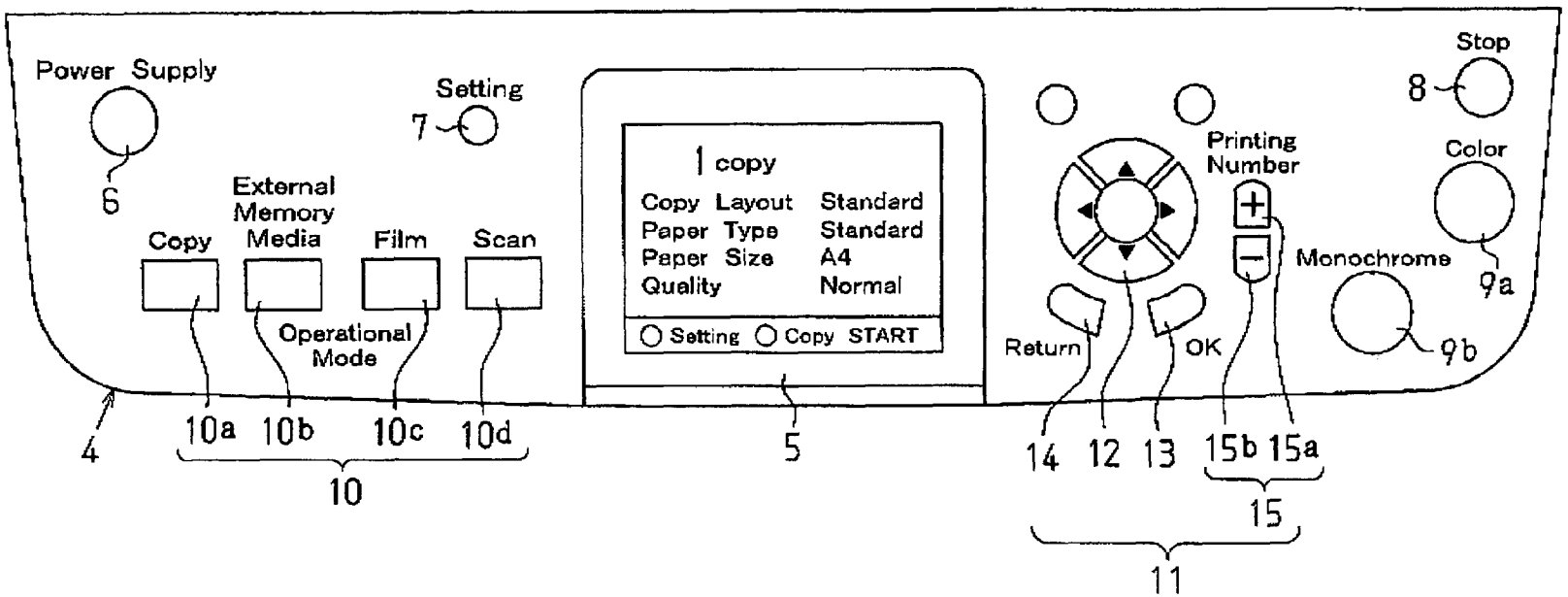
FIG. 2 is a plan view showing a manipulation panel of the multifunction machine of FIG. 1.

FIG. 2 is a plan view showing a manipulation panel 4 of the multifunction machine 1. The manipulation panel 4 is arranged on a front surface of the multifunction machine 1 and is includes different manipulation buttons, lamps, and a display. More specifically, a display (a liquid crystal display) 5 is provided in the manipulation panel 4 for displaying menus, setting items, and pictures. Further, the manipulation panel 4 has a power supply button 6 for selectively turning on and off the power supply, different setting buttons 7 for setting head cleaning, nozzle check, ink amounts, and gap adjustment, a stop button 8 for stopping currently performed operation, and two buttons 9*a*, 9*b* for starting printing/scanning. More specifically, the start button 9*a* corresponds to color printing/scanning and the start button 9*b* corresponds to monochrome printing/scanning.

Further, the manipulation panel 4 includes a group of operation mode selection buttons 10 for selecting an operation mode of the multifunction machine 1. The button group 10 includes a copy button 10*a*, an external memory media button 10*b*, a film button 10*c*, and a scan button 10*d*. The copy button 10*a* is depressed for carrying out local copy. The external memory media button 10*b* is depressed for performing direct printing or data backup. The film button 10*c* is depressed for reading and printing an image of a film such as a 35 mm film and a slide film. The scan button 10*d* is depressed for transmitting image data read by the scanning mechanism 16 to the host computer or performing scan-to-memory.

The manipulation panel 4 also includes a group of buttons 11 used for manipulating the cursor in a menu displayed on the display 5. The button group 11 includes a selection button 12 for selecting an item or a setting value, an OK button 13 for validating selected/altered setting, a back button 14 for canceling current setting, and print number buttons 15 for setting the number (of sets) of prints. The print number buttons 15 includes a plus button 15*a* for increasing the number of prints and a minus button 15*b* for decreasing the number of prints.

Figure 3:
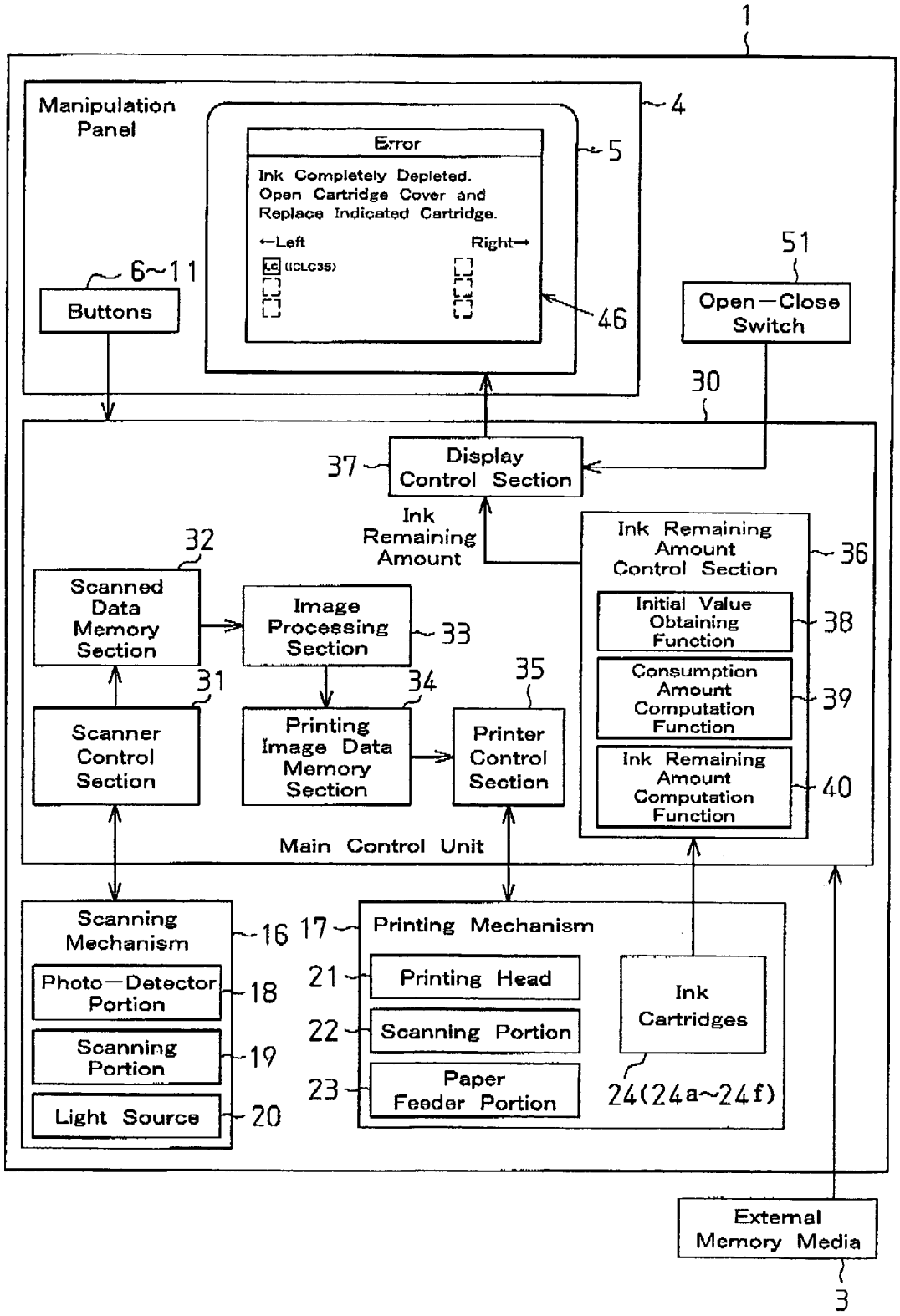
FIG. 3 is a block diagram representing the electric configuration of the multifunction machine of FIG. 1.

FIG. 3 is a block diagram representing the electrical configuration of the multifunction machine 1. The multifunction machine 1 is an inkjet printer and includes the scanning mechanism 16 and a printing mechanism 17. The scanning mechanism 16 scans the object on the table 2 and reads image data from the object. The printing mechanism 17 prints the image data on a paper or the like. The scanning mechanism 16 moves a photo-detector portion 18 in a predetermined direction by means of a scanning portion 19. In this manner, the photo-detector portion 18 detects the light of a light source 20 reflected by a surface of the object, thus obtaining an optical signal. The photo-detector portion 18 converts the optical signal to an electrical signal and outputs the resulting signal. The photo-detector portion 18 is formed by, for example, a plurality of line CCDs each having color filters of red, green and blue.

The printing mechanism 17 has a printing head 21, a scanning portion 22, a paper feeder portion 23, and a plurality of ink cartridges 24 (24*a* to 24*f*). The printing head 21 ejects ink (recording agent). The scanning portion 22 moves the printing head 21 in a predetermined direction. The paper feeder portion 23 moves a sheet of paper. The ink cartridges 24 supply ink of different colors to the printing head 21. While moving the printing head 21 in a main scanning direction by means of the scanning portion 22, the printing mechanism 17 ejects ink droplets from the printing head 21 at predetermined timings. The printing mechanism 17 performs printing in each proceeding cycle of the printing head 21 in the main scanning direction. The printing mechanism 17 also performs paper feeding, or moves the paper by a predetermined amount for the printing. By repeating the printing and the paper feeding alternately, the printing mechanism 17 subjects the sheet of paper to printing.

The multifunction machine 1 is an off-carriage type and the printing head 21 is provided separately from the ink cartridges 24. The ink is supplied from the ink cartridges 24 to the printing head 21 through a pump mechanism (not shown). In other words, each of the ink cartridges 24 is a stationary type, or is installed outside the scanning portion 22 and connected to the printing head 21 mounted on the scanning portion 22 for supplying the ink to the printing head 21. Since the ink cartridges 24 are not received in the printing head 21, the height of the off-carriage type multifunction machine 1 is advantageously small and the cartridges 24 are easy to replace. The multifunction machine 1 is advantageous also in that the printing head 21 is relatively light, thus improving the performing speed.

The ink cartridges 24 are provided in the quantity corresponding to the colors of the ink used by the multifunction machine 1. If, for example, the multifunction machine 1 uses ink of six colors, light cyan, cyan, black, magenta, light magenta, and yellow, six ink cartridges 24*a* to 24*f* are provided in the multifunction machine 1 correspondingly. Each of the ink cartridges 24*a* to 24*f* has a rewritable non-volatile memory (referred to as a "cartridge memory") such as EEPROM for storing information including the amount of the ink retained in the ink cartridge 24*a* to 24*f* and the product number of the ink cartridge 24*a* to 24*f*.

Figure 4:
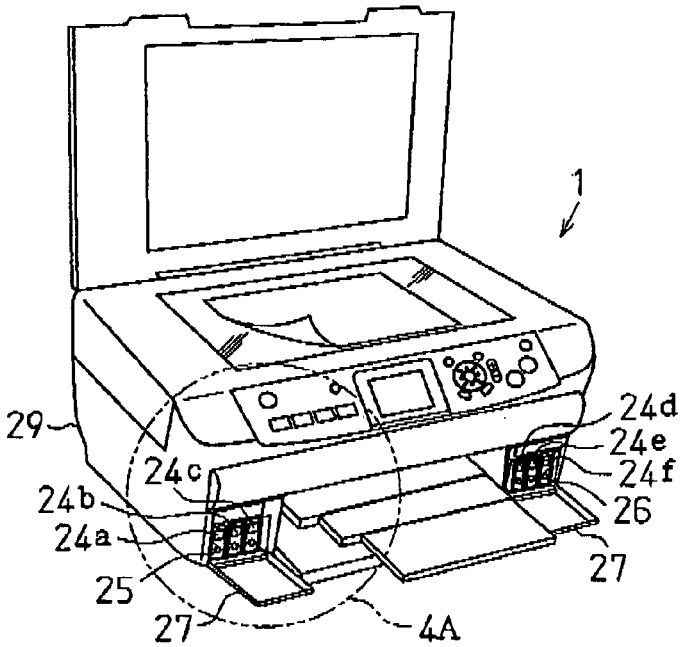
FIG. 4 is a perspective view showing the multifunction machine of FIG. 1 with covers held in open states.
Figure 4A:
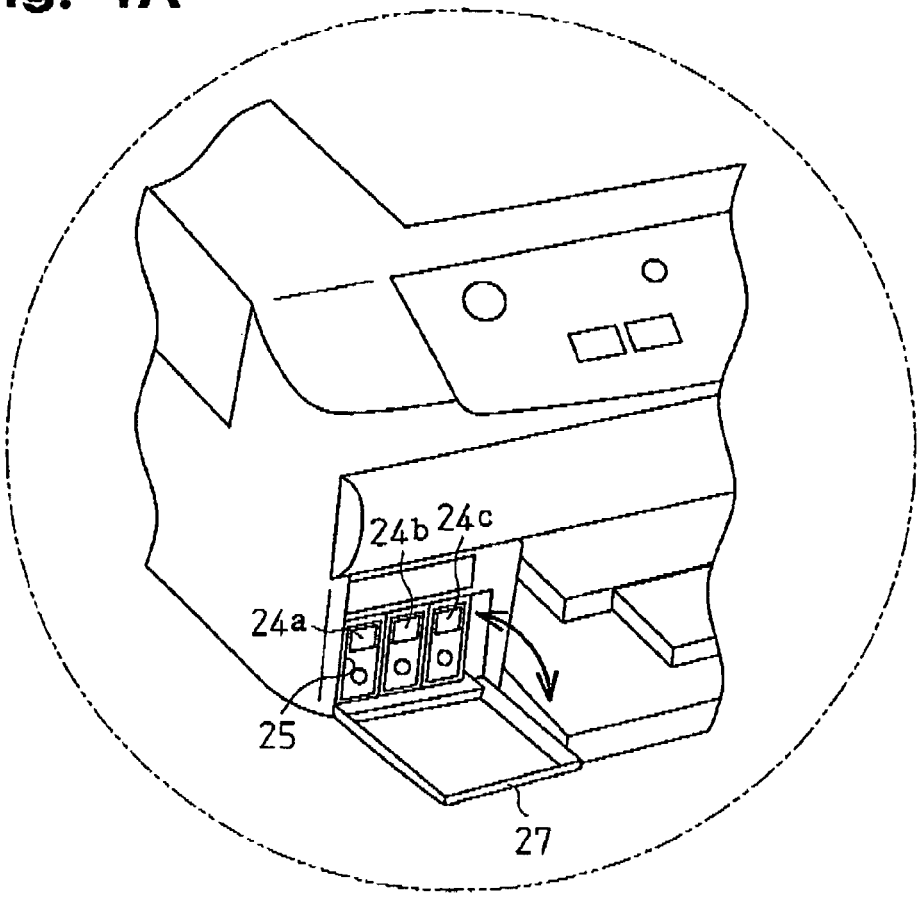
FIG. 4A is an enlarged view showing the portion encompassed by circle 4A of FIG. 4.

As shown in FIGS. 4 and 4A, two cartridge accommodation portions 25, 26 are arranged at opposing, right and left sides of a lower front portion of the multifunction machine 1. Each of the cartridge accommodation portions 25, 26 accommodates corresponding ones of the ink cartridges 24*a* to 24*f* retaining different color inks. If, for example, the multifunction machine 1 uses the aforementioned six color inks, the first cartridge accommodation portion 25 (located at, for example, the left) accommodates three ink cartridges 24*a*, 24*b*, 24*c* respectively retaining light cyan, cyan, and black inks. The second cartridge accommodation portion 26 (located at, for example, the right) accommodates three ink cartridges 24*d*, 24*e*, 24*f* respectively retaining magenta, light magenta, and yellow inks.

This arrangement decreases the height of the multifunction machine 1 and further reduces the multifunction machine 1 in thickness. That is, since a typical multifunction machine has a printing mechanism and a scanning mechanism, the bottom surface area of the multifunction machine is restricted by the printing mechanism and the scanning mechanism. Thus, if the multifunction machine is the off-carriage type and includes a relatively large number of cartridges, it is difficult to arrange a cartridge accommodation zone at only one of opposing, right and left ends of the multifunction machine, for reasons regarding the component layout. Thus, in this case, the cartridges must be installed at positions higher than a position corresponding to a paper outlet, resulting in a larger height of the multifunction machine. To solve this problem, in the off-carriage type multifunction machine 1 using the six color inks, the ink cartridges 24*a* to 24*f* are accommodated at two separate positions, thus maintaining the height of the multifunction machine 1, which is relatively small.

Covers 27, 28 are secured to the opposing right and left sides of the lower front portion of the multifunction machine 1 for covering the corresponding cartridge accommodation portions 25, 26. Each of the covers 27, 28 is supported in such a manner that a lower end of the cover 27, 28 is pivotable with respect to a body casing 29. The covers 27, 28 are selectively opened and closed in directions downward with respect to the body casing 29.

As shown in FIG. 3, the multifunction machine 1 includes the main control unit 30 that controls the multifunction machine 1 as a whole. The main control unit 30 is formed by, for example, a microcomputer system including a computation device (such as CPU and ASIC), a memory device (such as ROM and RAM), and input and output circuits, The main control unit 30 includes a scanner control section 31, a scanned data memory section 32, an image processing section 33, a printing image data memory section 34, a printer control section 35, an ink remaining amount control section 36, and a display control section 37. Each of these sections 31 to 37 is formed by a hardware circuit and/or software.

The scanner control section 31 controls scanner function of the multifunction machine 1. For example, when the copy button 10*a* is depressed, the multifunction machine 1 is switched to a copy mode. In this state, if printing instruction is generated by depressing the start button 9*a* for color printing or the start button 9*b* for monochrome printing, the scanner control section 31 operates the scanning mechanism 16 to read an image from an object placed on the table 2. The scanner control section 31 then operates the scanned data memory section 32 to store the obtained image data (scanned data). The scanned data memory section 32 is formed by a memory device such as RAM.

The image processing section 33 reads the scanned data from the scanned data memory section 32 and performs image processing as prescribed, thus generating printing image data. More specifically, the image processing section 33 generates the printing image data by performing processing such as color conversion from RGB calorimetric system to CMYK calorimetric system, size enlargement, size reduction, rotation, different types of correction, and halftone processing. The resulting printing image data is stored in the printing image data memory section 34, which is formed by a memory device such as RAM. The printer control section 35 obtains the printing image data from the printing image data memory section 34 and transfers the obtained data to the printing head 21, thus operating the printing head 21 to perform printing. The printer control section 35 also controls the scanning portion 22 and the paper feeder portion 23.

The ink remaining amount control section 36 functions as a detector section and detects and controls the amount of the ink retained in each of the ink cartridges 24*a* to 24*f*. The ink remaining amount control section 36 has an initial value obtaining function 38, an ink consumption amount computation function 39, and an ink remaining amount computation function 40. The initial value obtaining function 38 obtains an initial value, or an initial ink retaining amount of each ink cartridge 24*a* to 24*f* in an unused state. The ink consumption amount computation function 39 computes an ink consumption amount. The ink remaining amount computation function 40 computes an ink remaining amount from the initial value and the ink consumption amount. Each of these functions 38 to 40 is realized by a hardware circuit and/or software.

Although the ink remaining amount may be obtained by different methods, the ink consumption amount computation function 39 of the first embodiment computes the ink consumption amount in correspondence with, for example, the number of ejections and the amount of ink contained in a single ink droplet. The ink remaining amount computation function 40 computes the ink remaining amount X by subtracting the ink consumption amount from a previously obtained ink remaining amount (in the case of an initial use of the ink cartridge 24*a* to 24*f*, the initial ink retaining amount). The resulting ink remaining amount X is then stored in the corresponding cartridge memory, thus updating the cartridge memory. Alternatively, the ink remaining amount may be directly measured by means of a sensor such as an optical sensor and an electrostatic capacity sensor.

The display control section 37 controls the display 5 in accordance with manipulation of the buttons 6 to 11. The display control section 37 continuously monitors the ink remaining amount X computed by the ink remaining amount control section 36 for each of the ink cartridges 24*a* to 24*f*. The display control section 37 compares the ink remaining amount X with a first threshold value Ka and a second threshold value Kb each time the ink remaining amount X is computed. The display control section 37 thus controls operation of the display 5 depending on the comparison. The first threshold value Ka corresponds to a reference value depending on which it is determined whether or not the ink supply of each ink cartridge 24*a* to 24*f* is completely depleted. The second threshold value Kb corresponds to a reference value depending on which it is determined whether or not the ink supply of the ink cartridge 24*a* to 24*f* is close to complete depletion. The second threshold value Kb is thus set to a value larger than the first threshold value Ka.

If it is determined that the ink remaining amount X is smaller than the second threshold value Kb (X<Kb) based on the aforementioned comparison, the display control section 37 determines that the ink supply of the ink cartridge 24 is close to complete depletion, or the ink cartridge 24 is in an "ink near-end" status. The display control section 37 then displays an ink near-end screen 41 of FIG. 5 on the display 5. The ink near-end screen 41 displays a plurality of printing state messages 42, three lamps 43 corresponding to three printing stages, a notice message (notice information) 44 for notifying the user of the ink near-end status, and an identification mark 45 of the ink cartridge 24 in the ink near-end status. The printing state messages 42 include a "now printing" notice, a total printing number, and a remaining printing number. Further, in the first embodiment, the notice message 44 is displayed as "Ink Close to Complete Depletion".

The identification mark 45 is displayed as a square frame having the inside colored in correspondence with the ink cartridge 24 in the ink near-end status. The characters indicating the color of the ink cartridge 24 is displayed in the square frame. For example, in FIG. 5, the identification mark 45 is displayed as a square frame having a light magenta inside and characters "LM" indicating light magenta. If a plurality of ink cartridges 24 are in ink near-end status, a plurality of identification marks 45 are displayed as aligned from one end (the left end in FIG. 5) toward the opposing end, in accordance with the order in which the ink near-end statuses have been detected.

If it is determined that the ink remaining amount X has become further smaller and is smaller than the first threshold value Ka (X<Ka) based on the comparison, the display control section 37 determines that the ink supply of the ink cartridge 24 is completely depleted. The display control section 37 then displays an ink-end screen 46 of FIG. 6 on the display 5. At this stage, the display control section 37 sends a printing suspension instruction to the printer control section 35. In response to the instruction, the printer control section 35 suspends printing. The ink-end screen 46 displays a message 47 that the cartridge 24 requires replacement (replacement requirement message or replacement requirement information), thus requiring replacement of the cartridge 24, information (position information) 48 regarding the position of the cartridge accommodation portion 25, 26 accommodating the cartridge 24 that requires replacement, and an identification mark 49 corresponding to the cartridge 24.

Since the cartridge accommodation portions 25, 26 of the first embodiment are arranged at the opposing right and left sides of the multifunction machine 1, the position information 48 is represented by characters such as "right" and "left". However, as long as the position of the corresponding cartridge accommodation portion 25, 26 is accurately indicated, the position information 48 may be displayed in any suitable manners other than using the characters "right" and "left". For example, if one of the cartridge accommodation portions 25, 26 is defined as "a first accommodation portion" and the other as "a second accommodation portion", the characters "first accommodation portion" and "second accommodation portion" may be displayed on the display 5.

The identification mark 49 displayed on the ink-end screen 46 is a square frame similar to the identification mark 45 displayed on the ink near-end screen 41. That is, the identification mark 49 is a square frame that has the inside colored in correspondence with the ink cartridge 24 requiring replacement and includes characters indicating the color. The identification marks 49*a* to 49*f* are displayed in zones corresponding to the position information 48 "right" and "left" of the ink-end screen 46. In each of the zones, the identification marks 49*a* to 49*f* are displayed as aligned in the order in which the corresponding ink cartridges 24*a* to 24*b* are arranged. In other words, a left zone of the ink-end screen 46 corresponds to a display zone for the identification marks 49*a* to 49*c* of the cartridges 24*a* to 24*c* of light cyan, cyan, and black inks. A right zone of the ink-end screen 46 corresponds to a display zone for the identification marks 49*d* to 49*f* of the cartridges 24*d* to 24*f* of magenta, light magenta, and yellow inks. More specifically, the identification mark 49*a* of the light cyan ink cartridge 24*a* is displayed immediately below the position information 48 represented by "Left". The identification mark 49*b* of the cyan ink cartridge 24*b* is displayed immediately below the identification mark 49*a*. The identification mark 49*c* of the black ink cartridge 24*c* is displayed immediately below the identification mark 49*b*. Similarly, the identification mark 49*d* of the magenta ink cartridge 24*d* is displayed immediately below the position information 48 represented by "Right". The identification mark 49*e* of the light magenta ink cartridge 24*e* is displayed immediately below the identification mark 49*d*. The identification mark 49*f* of the yellow ink cartridge 24*f* is displayed immediately below the identification mark 49*e*.

A product number 50 corresponding to each of the ink cartridges 24*a* to 24*f* is displayed adjacent to the corresponding identification mark 49*a* to 49*f*. The identification marks 49 (49*a* to 49*f*) representing color information and the product numbers 50 correspond to detailed information regarding the cartridges 24 that require replacement or the identification information regarding these cartridges 24. Since the detailed information (49, 50) is displayed as arranged in zones corresponding to the position information 48 "Left" and "Right", the position of the cartridge 24 requiring replacement and the position of the cartridge accommodation portion 25, 26 accommodating the cartridge 24 requiring replacement can be identified. That is, the detailed information (49, 50) defines a part of the information (the position information) regarding the position of the cartridge 24 requiring replacement and the position of the cartridge accommodation portion 25, 26 accommodating the cartridge 24 requiring replacement.

As shown in FIG. 3, the multifunction machine 1 includes two open-close switches 51 in correspondence with the covers 27, 28. Each of the open-close switches 51 serves as a detector for detecting an open-closed state of the corresponding cover 27, 28. Each open-close switch 51 is formed by a contact type ON-OFF switch and, for example, outputs an ON signal when the corresponding cover 27 (28) is closed and an OFF signal when the cover 27 (28) is open. In correspondence with the signal inputted from the open-close switches 51, the display control section 37 acquires the open-closed states of the covers 27, 28. More specifically, the display control section 37 determines that the left cover 27 is open if the ON signal from the left open-close switch 51 changes to the OFF signal and that the right cover 28 is open if the ON signal from the right open-close switch 51 changes to the OFF signal.

Figure 6:
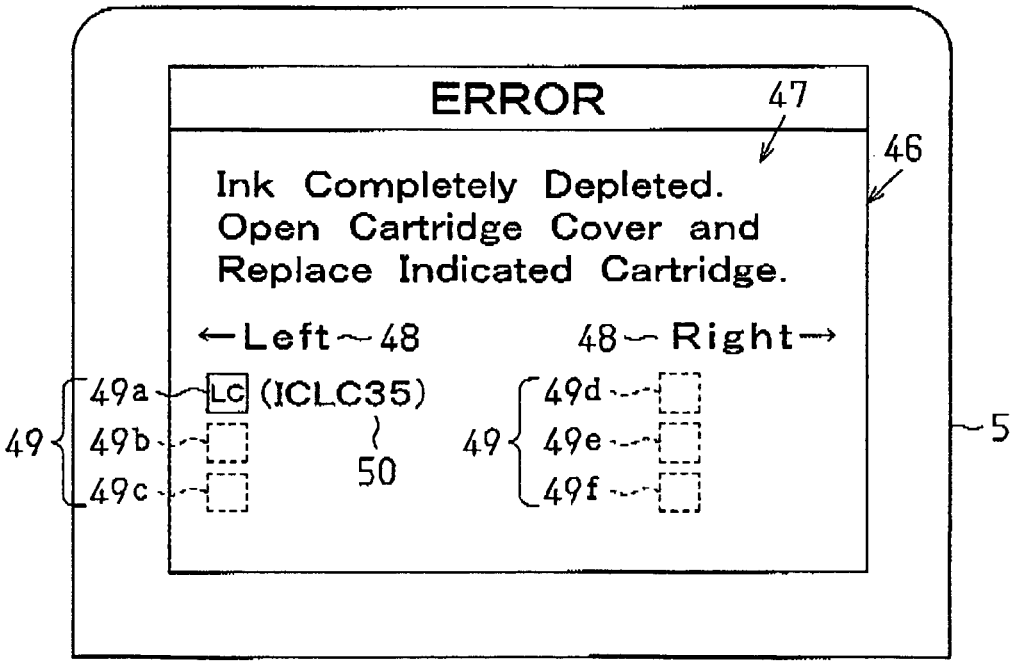
FIG. 6 is a view showing an ink-end screen displayed on the display.
Figure 7:
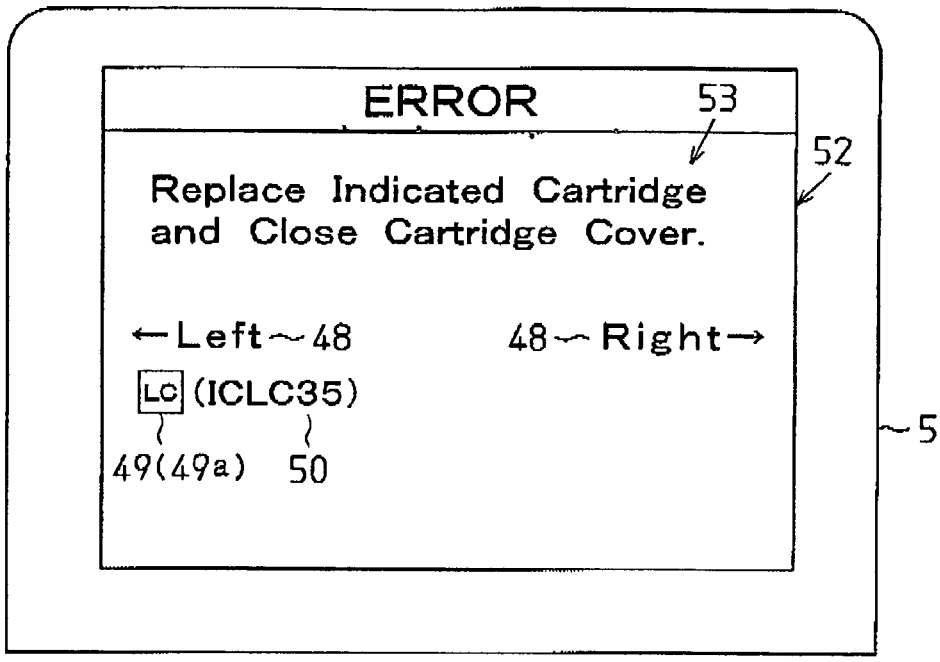
FIG. 7 is a view showing an instruction screen displayed on the display.

If the display control section 37 determines that the cover 27 (28) of the cartridge accommodation portion 25 (26) accommodating the cartridge 24 that requires replacement is open, the ink-end screen 46 of FIG. 6 is replaced by an instruction screen 52 of FIG. 7, which is displayed on the display 5. This informs the user of subsequent user operation. The instruction screen 52 continuously display the position information 48, the identification mark 49, and the product number 50, which have been displayed on the ink-end screen 46. The instruction screen 52 also displays an instruction message (instruction information) 53 for instructing a procedure of cartridge replacement.

Figure 8:
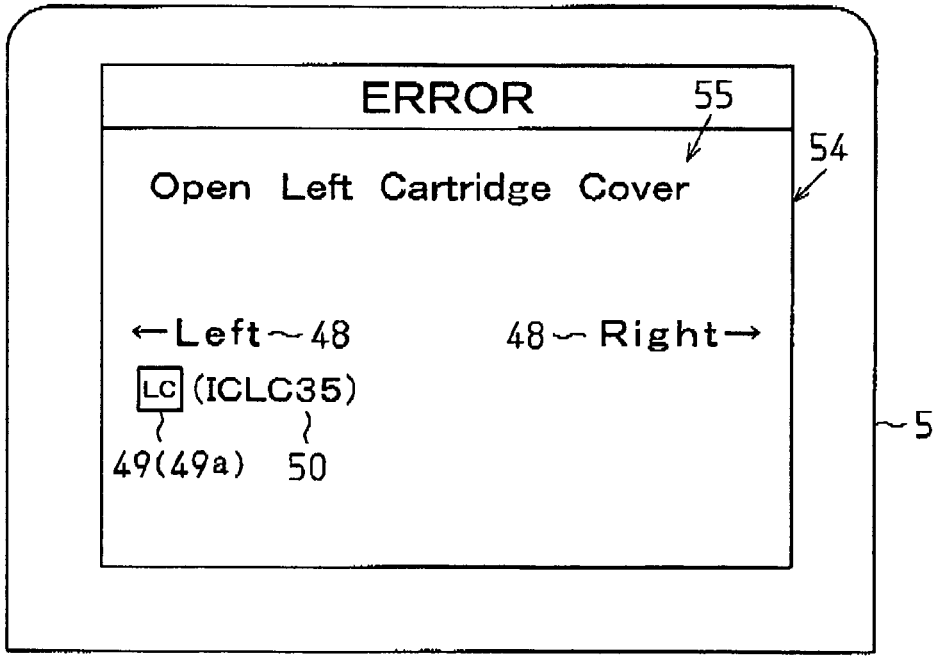
FIG. 8 is a view showing an alert screen displayed on the display.

In contrast, if the display control section 37 determines that the cover 27 (28) other than the designated cover 27 (28), which corresponds to the cartridge accommodation portion 25 (26) accommodating the cartridge 24 requiring replacement, is open, the ink-end screen 46 is replaced by an alert screen 54 of FIG. 8, which is displayed on the display 5. The alert screen 54 continuously display the position information 48, the identification mark 49, and the product number 50, which have been displayed on the ink-end screen 46. The alert screen 54 also displays an alert message (alert information) 55 requiring that the designated cover 27 (28) be opened. Further, an error indicating LED (not shown) may be provided on the manipulation panel 4 and activated when the alert screen 54 is displayed.

When determining that the cartridge replacement has been completed normally, or the cartridge 24 requiring replacement has been replaced normally, the display control section 37 sends a printing resuming instruction to the printer control section 35. Although the suspended printing may be simply resumed following the cartridge replacement, the printing may be repeated from a first line of the page at which the printing has been suspended.

Figure 5:
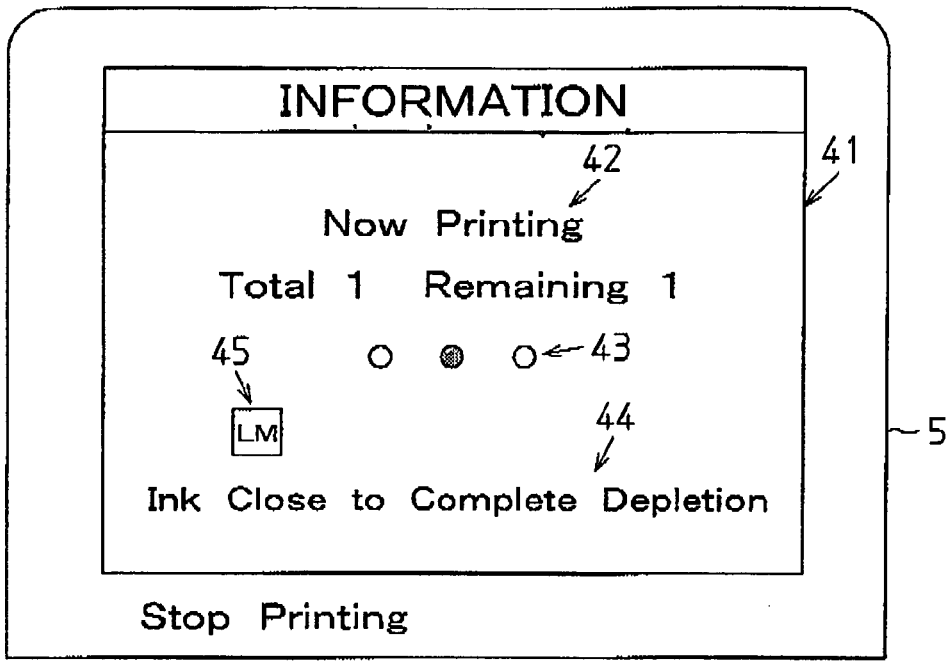
FIG. 5 is a view showing an ink near-end screen displayed on a display.

The ink in each of the ink cartridges 24*a* to 24*f* is consumed by printing and the corresponding ink remaining amount X gradually decreases. When the ink remaining amount X of any one of the ink cartridges 24*a* to 24*f* becomes smaller than the second threshold value Kb, the ink near-end screen 41 of FIG. 5 is displayed on the display 5. The ink near-end screen 41 displays the identification mark 45 corresponding to the ink cartridge 24*a* to 24*f* the ink supply of which is close to complete depletion. This allows the user to acknowledge the ink near-end status of the ink cartridge 24*a* to 24*f* corresponding to the identification mark 45 displayed on the display 5. In this state, currently performed printing is continued.

When the ink remaining amount X of the ink cartridge 24*a* to 24*f* becomes smaller than the first threshold value Ka, the ink-end screen 46 of FIG. 6 is displayed on the display 5 and the currently performed printing is suspended. The ink-end screen 46 displays the position information 48, the identification mark 49, and the product number 50 corresponding to the cartridge 24*a* to 24*f* requiring replacement. This allows the user to easily acknowledge which of the cartridge accommodation portions 25, 26 corresponds to the cartridge 24*a* to 24*f* requiring replacement. The user thus opens the cover 27 (28) designated by the ink-end screen 46 for replacing the corresponding cartridge 24.

At this stage, if the cover 27 (28) other than the designated one is opened erroneously, the alert screen 54 of FIG. 8 is displayed on the display 5. This allows the user to acknowledge the erroneous operation immediately, making it easy for the user to smoothly carrying out cartridge replacement. When the cartridge replacement is completed and the corresponding cover 27 (28) is closed, printing is resumed by, for example, depressing the start button 9*a* (9*b*).

Figure 9:
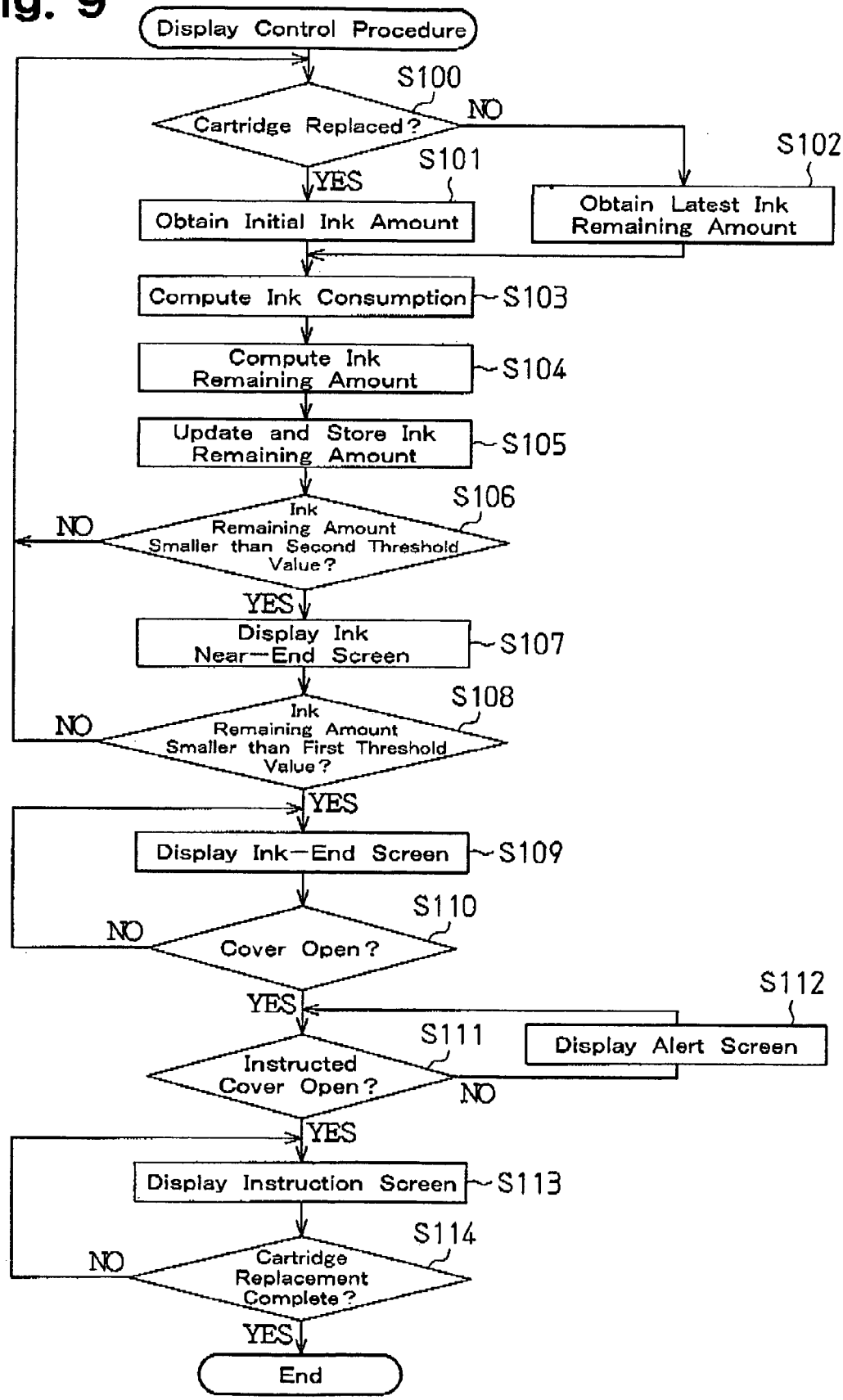
FIG. 9 is a flowchart representing a display control procedure executed by a main control unit.

A display control procedure performed by the main control unit 30 will be described with reference to the flowchart of FIG. 9.

In step 100, the main control unit 30 determines whether or not each of the ink cartridges 24*a* to 24*b* has been recently replaced. If positive determination is made for any one of the ink cartridges 24*a* to 24*f*, the main control unit 30 obtains the initial ink retaining amount of this ink cartridge 24*a* to 24*f* in step 101. In contrast, in step 102, the main control unit 30 obtains a latest ink remaining amount Xa for each of the other ink cartridges 24*a* to 24*f* from the corresponding cartridge memory.

In step 101, the initial ink retaining amount may be obtained by reading the value from the corresponding cartridge memory. Alternatively, if the initial ink retaining amount corresponding to each of the cartridges 24*a* to 24*f* is pre-stored in a memory of the multifunction machine 1 according to the product numbers, the initial ink retaining amount may be read from this memory.

In step 103, the main control unit 30 computes the amount of the ink of each ink cartridge 24*a* to 24*f* that has been consumed by printing. The ink consumption amount may be computed by, for example, multiplying the number of ink ejections by the amount of ink in a single droplet if these values are known.

In step 104, the main control unit 30 computes a renewed ink remaining amount X for each of the ink cartridges 24*a* to 24*f*. The ink remaining amount X is computed by subtracting the ink consumption amount from the initial ink retaining amount or the latest ink remaining amount Xa.

In step 105, the main control unit 30 overwrites the corresponding cartridge memory (or the memory of the multifunction machine 1) for storing the ink remaining amount X obtained in step 104 for each ink cartridge 24*a* to 24*f*, thus updating the memory.

In step 106, the main control unit 30 determines for each ink cartridge 24*a* to 24*f* whether or not the corresponding ink remaining amount X obtained in step 104 is smaller than the second threshold value Kb (X<Kb). As long as the determination is negative, the main control unit 30 determines that the ink remaining amount X of each ink cartridge 24*a* to 24*b* is sufficient, thus repeating step 100. However, if it is determined that the ink remaining amount X of any one of the ink cartridges 24*a* to 24*f* is smaller than the second threshold value Kb, the main control unit 30 determines that the cartridge 24*a* to 24*f* is in the ink near-end status. The main control unit 30 then executes step 107.

In step 107, the main control unit 30 displays the ink near-end screen 41 of FIG. 5 on the display S. This allows the user to acknowledge the ink near-end status of the ink cartridge 24*a* to 24*f*.

In step 108, the main control unit 30 determines, for at least the ink cartridge 24*a* to 24*f* having the ink remaining amount X smaller than the second threshold value Kb, whether or not the ink remaining amount X obtained in step 104 is smaller than the first threshold value Ka (X>Ka). If the determination is negative, the main control unit 30 repeats step 100, thus monitoring the ink remaining amount X of each ink cartridge 24*a* to 24*f* and continuously displaying the ink near-end screen 41. However, if it is determined that the ink remaining amount X is smaller than the first threshold value Ka, the main control unit 30 determines that the corresponding ink cartridge 24*a* to 24*f* is in the ink-end status (an ink depletion state) and performs step 109.

In step 109, the main control unit 30 displays the ink-end screen 46 of FIG. 6 on the display 5. This allows the user to acknowledge which of the ink cartridges 24*a* to 24*f* is in the ink-end status.

In step 110, the main control unit 30 determines whether or not the cover 27 (28) has become open. If the determination is positive, the main control unit 30 performs step 111. If the determination is negative, the main control unit 30 repeats step 109, thus continuously displaying the ink-end screen 46.

In step 111, the main control unit 30 whether or not the cover 27 (28) held in the open state corresponds to the designated cover 27 (28), which corresponds to the cartridge accommodation portion 25 (26) accommodating the ink cartridge 24*a* to 24*f* requiring replacement. If the cover 27 (28) other than the designated cover 27 (28) has been opened erroneously, the main control unit 30 performs step 112 for informing the user of the error. In contrast, if the designated cover 27 (28) has been opened, the main control unit 30 executes step 113.

In step 112, the main control unit 30 displays the alert screen 54 of FIG. 8 on the display 5. This allows the user to acknowledge that the cover (27) 28 other than the designated cover 27 (28) has been opened erroneously.

In step 113, the main control unit 30 displays the instruction screen 52 of FIG. 7 on the display 5.

In step 114, the main control unit 30 determines whether or not cartridge replacement has been completed. Such completion is confirmed through detection of the cartridge replacement (by, for example, a non-illustrated sensor) and manipulation of the cover 27 (28) from an open state to a closed state, which corresponds to switching of the open-close switch 51 from an OFF state to an ON state. If the cartridge replacement is incomplete, the main control unit 30 repeats step 113 for continuously displaying the instruction screen 52. Contrastingly, if the cartridge replacement is complete, the display control procedure is suspended.

The first embodiment has the following advantages.

(1) When the ink remaining amount X of any one of the ink cartridges 24*a* to 24*f* becomes smaller than the first threshold value Ka, it is indicated that the ink supply of the ink cartridge 24*a* to 24*f* is completely depleted. In this state, the ink-end screen 46 is displayed on the display 5. The ink-end screen 46 displays the position information 48, the identification mark 49, and the product number 50 corresponding to the ink cartridge 24*a* to 24*f* requiring replacement. Thus, even though the multifunction machine 1 of the first embodiment has the multiple cartridge accommodation portions 25, 26, the user is accurately notified of the position information of the cartridge requiring replacement. This makes it easy for the user to smoothly perform cartridge replacement.

(2) When the ink remaining amount X of any one of the ink cartridges 24*a* to 24*f* becomes smaller than the second threshold value Kb, it is indicated that the ink supply of the ink cartridge 24*a* to 24*f* is close to complete depletion. In this state, the ink near-end screen 41 is displayed on the display 5. This allows the user to acknowledge the ink near-end of the ink cartridge 24*a* to 24*f*.

(3) The ink-end screen 46 displays not only the position information 48 of the cartridge 24*a* to 21*f* requiring replacement but also the corresponding identification mark 49 and product number 50. This allows the user to acknowledge which one of the ink cartridges 24*a* to 24*f* needs replacement.

(4) The identification marks 49*a* to 49*f* are displayed on the ink-end screen 46 in the order in which the corresponding ink cartridges 24*a* to 24*f* are arranged in the cartridge accommodation portions 25, 26. Thus, even though each of the cartridge accommodation portions 25, 26 accommodates multiple cartridges 24, the ink-end screen 46 allows the user to easily acknowledge the position of the cartridge 24 requiring replacement in the corresponding accommodation portion 25, 26. The cartridge replacement is thus facilitated.

(5) When the cover 27 (28) of the cartridge accommodation portion 25 (26) accommodating the cartridge 24 requiring replacement is opened, the instruction screen 52 is displayed on the display 5, thus instructing the procedure of the cartridge replacement. This allows the user to complete the cartridge replacement in accordance with the instructions displayed on the instruction screen 52, thus suppressing erroneous user operation.

(6) If the cover 27 (28) other than the cover 27 (28) designated by the ink-end screen 46 is erroneously opened for the cartridge replacement, the alert screen 54 is displayed on the display 5 and requires that the designated cover 27 (28) be opened. Thus, even if the cover 27 (28) is opened erroneously, the alert screen 54 allows the user to acknowledge the error immediately.

A second embodiment of the present invention will hereafter be described with reference to FIG. 10. The description will focus on the difference between the first embodiment and the second embodiment. In the second embodiment, the ink-end screen 46 of the first embodiment shown in FIG. 6 is replaced by an ink-end screen 60 of FIG. 10, which is displayed on the display 5. The other parts of the second embodiment are configured in the same manner as the corresponding parts of the first embodiment.

Figure 10:
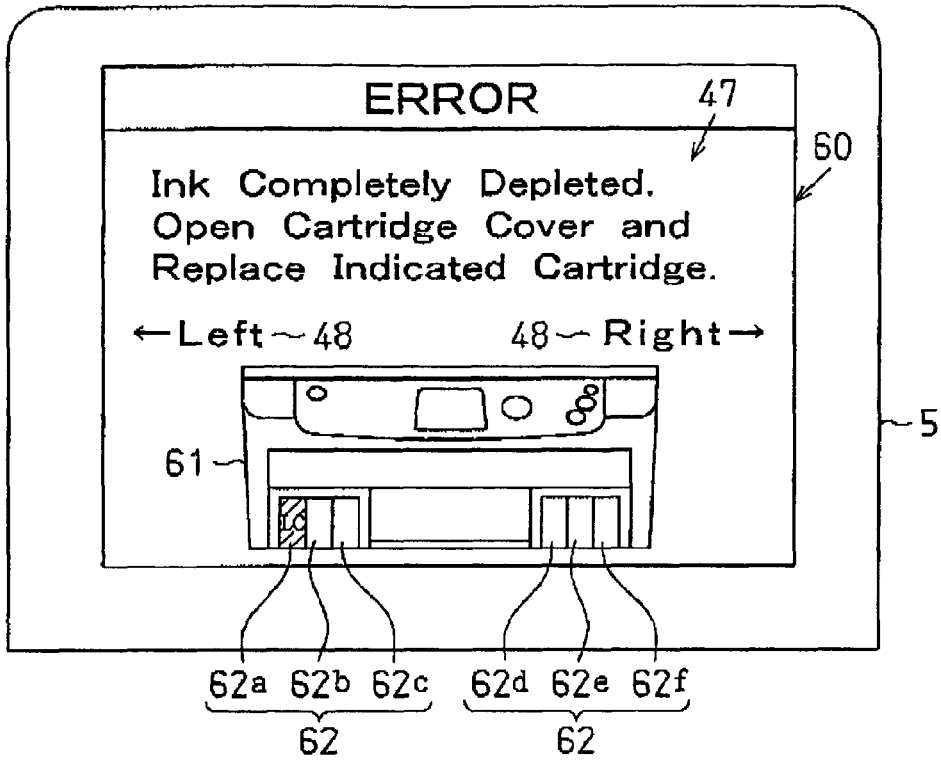
FIG. 10 is a view showing an ink-end screen according to a second embodiment.

As shown in FIG. 10, like the first embodiment, the ink-end screen 60 of the second embodiment displays the cartridge replacement message 47 and the information (the position information) 48 regarding the cartridge accommodation portion 25, 26 accommodating the cartridge 24 that require replacement. However, unlike the ink-end screen 46 of FIG. 6, the ink-end screen 60 displays a graphical representation 61 of the appearance of the multifunction machine 1 on the display 5 as information (detailed information or identification information) regarding the cartridge 24 requiring replacement. The graphical representation 61 includes identification marks 62 (62*a* to 62*f*) of the cartridges 24 (24*a* to 24*f*) Each of the identification marks 62 flashes or lights up if the corresponding cartridge 24 requires replacement, at a position corresponding to the location of this cartridge 24. The graphical representation 61 and the identification marks 62 correspond to the information (the position information) regarding the position of the cartridge 24 requiring replacement and the position of the accommodation portion 25, 26 accommodating the cartridge 24 requiring replacement.

In this state, the identification mark 62 (62*a* to 62*f*), as color information, has a square frame having the inside colored in correspondence with the corresponding cartridge 24 that requires replacement and characters representing the color of the corresponding cartridge 24 are displayed in the square frame. More specifically, the identification mark 62 is displayed at a position in the graphical representation 61 corresponding to the actual location of the corresponding cartridge 24 in the multifunction machine 1. For example, in FIG. 10, the ink-end screen 60 indicates that the light cyan cartridge 24*a* accommodated in the cartridge accommodation portion 25 requires replacement. Further, in addition to the identification mark 62, the product number 50 (FIG. 6) may be displayed on the display 5.

In the second embodiment, the ink-end screen 60 allows the user to quickly acknowledge the position of the cartridge 24 requiring replacement from the graphical representation 61. Accordingly, compared to a case in which the position information of the cartridge 24 requiring replacement is indicated only by the corresponding characters, the cartridge replacement is smoothly performed.

The illustrated embodiments may be modified in the following forms.

In the first embodiment, the ink-end screen 46 of FIG. 6 does not necessarily have to display all of the position information 48, the identification mark 49, and the product number 50. That is, for example, the ink-end screen 46 may include only the position information 48. More specifically, if any one of the cartridges 24 in the left cartridge accommodation portion 25 requires replacement, the ink-end screen 46 simply displays the characters "left". If any one of the cartridges 24 in the right cartridge accommodation portion 26 requires replacement, the ink-end screen 46 simply displays the characters "right".

Figure 11:
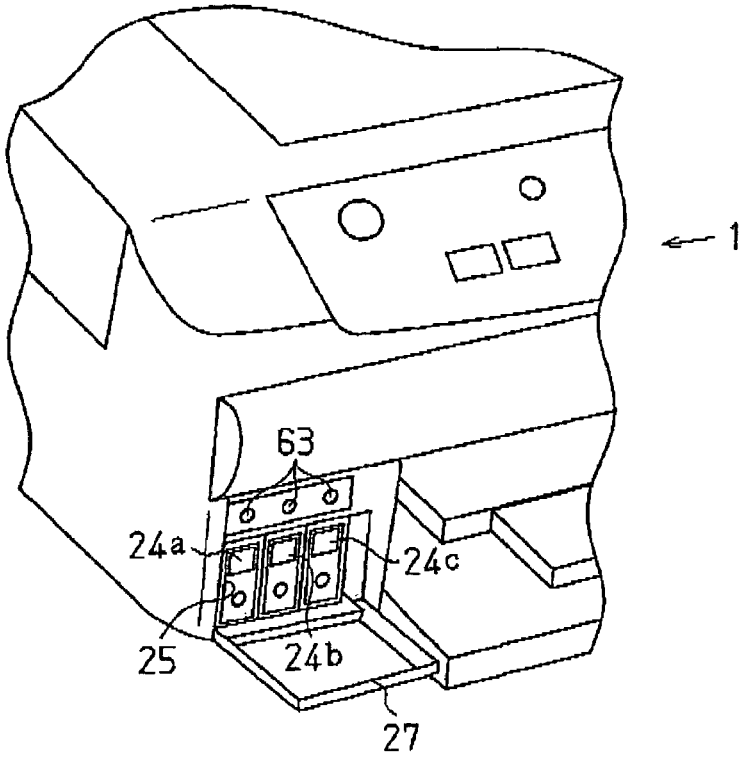
FIG. 11 is an enlarged perspective view showing arrangement of LED lamps of a modified example.

The position information of the cartridge 24 requiring replacement does not necessarily have to be displayed on the display 5. For example, as shown in FIG. 11, LED lamps 63 serving as indicator lamps (indicators) may be arranged in the multifunction machine 1 at positions corresponding to the locations of the ink cartridges 24*a* to 24*f*. When any one of the ink cartridges 24*a* to 24*f* requires replacement due to complete depletion of the corresponding ink supply, the control section 37 activates the associated one of the LED lamps 63 (to light up or flash). Although FIG. 11 shows only the LED lamps 63 corresponding to the ink cartridges 24*a* to 24*c* in the cartridge accommodation portion 25, similar LED lamps are provided for the ink cartridges 24*d* to 24*f* in the cartridge accommodation portion 26.

In the first embodiment, the ink-end screen 46 of FIG. 6 displays the identification marks 49*a* to 49*f* at positions corresponding to the cartridge accommodation portions 25, 26 as arranged in the order in which the corresponding cartridges 24*a* to 24*f* are installed in the cartridge accommodation portions 25, 26. However, the identification marks 49 may be arranged in any suitable manner other than that of the first embodiment. For example, the identification marks 49*a* to 49*f* of the light cyan, cyan, black, magenta, light magenta, yellow ink cartridges 24*a* to 24*f* may be aligned in a single line in this order from the left side of the ink-end screen 46 in accordance with the actual arrangement order of the ink cartridges 24*a* to 24*f*.

The first threshold value Ka and the second threshold value Kb may be changed as needed. Further, the ink near-end screen 41 may be omitted.

The multifunction machine 1 does not necessarily have to have two cartridge accommodation portions 25, 26 but three or more cartridge accommodation portions may be provided. Further, the multifunction machine 1 does not necessarily have to use the six color inks but may employ only four color inks of cyan, magenta, yellow, and black.

The detailed information (the identification information) is not restricted to the identification mark 49 or the product number 50. The detained information may include the date of the initial use of the cartridge 24 if the corresponding cartridge memory is capable of storing such date.

The present invention may be applied to a printer other than the multifunction machine 1, for example, to a printer without scanner function (a stand-alone type). Further, the printer of the present invention does not necessarily have to be capable of reading an image data from the external memory media 3 and printing the data.

The printer of the present invention is not restricted to the inkjet type but may be a dot-impact type, a thermal type, a thermal transfer type, or a laser type.

The display for displaying the position information is not restricted to the display 5 of the multifunction machine 1. That is, for example, if the multifunction machine 1 is connected to a host computer such as a personal computer, the position information of the cartridge 24 requiring replacement may be displayed on a display connected to the host computer. In this case, operation of the display control section 37 may be carried out by a printer driver program (more specifically, a utility program controlling user interface) installed in the host computer.

The present examples and embodiments are to be considered as illustrative and not restrictive and the invention is not to be limited to the details given herein, but may be modified within the scope and equivalence of the appended claims.

The invention claimed is:

1. A method for displaying information regarding cartridges installed in a printer on a display, the printer including cartridge accommodation portions provided at different positions, each of the accommodation portions being capable of accommodating a plurality of the cartridges retaining a recording agent, wherein the method comprises:

detecting a remaining amount of the recording agent retained in each of the cartridges; and operating the display to display position information of the cartridge accommodation portion that accommodates the cartridge in which the remaining amount of the recording agent is smaller than a predetermined threshold value, the position information indicating the location of the cartridge accommodation portion with respect to the printer.

2. The method according to claim 1, further comprising operating the display to display a replacement requirement message requiring that the cartridge in which the remaining amount of the recording agent is smaller than the threshold value be replaced.

3. The method according to claim 1, wherein the threshold value is a first threshold value, and wherein the method further comprises operating the display, when the detected remaining amount is smaller than a second threshold value larger than the first threshold value, to display a message that the remaining amount of the recording agent in the corresponding cartridge is relatively small.

4. The method according to claim 1, further comprising operating the display to display identification information regarding the cartridge in which the remaining amount of the recording agent is smaller than the threshold value in association with the position information.

5. The method according to claim 4, wherein the identification information includes at least one of information representing the color of the recording agent in the cartridge and information representing the product number of the cartridge.

6. The method according to claim 4, wherein each of the accommodation portions accommodates multiple cartridges that are arranged in a predetermined order, and wherein the identification information is displayed as arranged in an order corresponding to an actual arrangement order of the cartridges in each accommodation portion.

7. The method according to claim 1, wherein the position information includes at least one of character information and a graphical representation of the position at which the accommodation portion is located with respect to the printer.

8. The method according to claim 1, further comprising:

operating the display to display a graphical representation of the appearance of the printer; and displaying identification information of the cartridge in which the remaining amount of the recording agent is smaller than the threshold value at a position in the graphical representation corresponding to the actual location of that cartridge with respect to the printer.

9. The method according to claim 1, wherein each of the accommodation portions is covered with a cover that can be selectively opened and closed, and wherein the method further comprises operating the display to display information regarding a cartridge replacement procedure when the cover of the accommodation portion corresponding to the position information is opened with the position information displayed on the display.

10. The method according to claim 9, further comprising operating the display to display an alert message if the cover different than the cover of the accommodation portion corresponding to the position information is opened with the position information displayed on the display.

11. An apparatus for displaying information regarding cartridges installed in a printer on a display, the printer including cartridge accommodation portions provided at different positions, each of the accommodation portions being capable of accommodating a plurality of the cartridges retaining a recording agent, wherein the apparatus comprises:

a detector section for detecting a remaining amount of the recording agent retained in each of the cartridges; and a display control section for controlling the display, wherein the display control section operates the display to display position information of the cartridge accommodation portion that accommodates the cartridge in which the remaining amount of the recording agent is smaller than a predetermined threshold value, the position information indicating the location of the cartridge accommodation portion with respect to the printer.

12. The apparatus according to claim 11, wherein the display control section operates the display to display a replacement requirement message requiring that the cartridge in which the remaining amount of the recording agent is smaller than the threshold value be replaced.

13. The apparatus according to claim 11, wherein the threshold value is a first threshold value, and wherein, when the detected remaining amount is smaller than a second threshold value larger than the first threshold value, the display control section operates the display to display a message that the remaining amount of the recording agent in the corresponding cartridge is relatively small.

14. The apparatus according to claim 11, wherein the display control section operates the display to display identification information regarding the cartridge in which the remaining amount of the recording agent is smaller than the threshold value in association with the position information.

15. The apparatus according to claim 14, wherein the identification information includes at least one of information representing the color of the recording agent in the cartridge and information representing the product number of the cartridge.

16. The apparatus according to claim 14, wherein each of the accommodation portions accommodates multiple cartridges that are arranged in a predetermined order, and wherein the display control section operates the display to display the identification information as arranged in an order corresponding to an actual arrangement order of the cartridges in each accommodation portion.

17. The apparatus according to claim 11, wherein the position information includes at least one of character information and a graphical representation of the position at which the accommodation portion is located with respect to the printer.

18. The apparatus according to claim 11, wherein the display control section operates the display to display a graphical representation of the appearance of the printer and identification information of the cartridge in which the remaining amount of the recording agent is smaller than the threshold value at a position in the graphical representation corresponding to the actual location of that cartridge with respect to the printer.

19. The apparatus according to claim 11, wherein each of the accommodation portions is covered with a cover that can be selectively opened and closed, and wherein the display control section operates the display to display information regarding a cartridge replacement procedure when the cover of the accommodation portion corresponding to the position information is opened with the position information displayed on the display.

20. The apparatus according to claim 19, wherein the display control section operates the display to display an alert message if the cover different than the cover of the accommodation portion corresponding to the position information is opened with the position information displayed on the display.

21. A printer comprising:

a plurality of cartridges each retaining a recording agent;

cartridge accommodation portions provided at different positions in the printer, each of the accommodation portions being capable of accommodating more than one of the cartridges;

a printing mechanism performing printing using the recording agent in each of the cartridges;

a detector section for detecting a remaining amount of the recording agent in each of the cartridges;

a display; and a display control section for controlling the display, wherein, the display control section operates the display to display position information of the cartridge accommodation portion that accommodates the cartridge in which the remaining amount of the recording agent is smaller than a predetermined threshold value, the position information indicating the location of the cartridge accommodation portion with respect to the printer.

22. The printer according to claim 21, wherein the printing mechanism includes:

a printing head to which the recording agent is supplied from each of the cartridges; and a scanning portion for moving the printing head in a predetermined direction, wherein the cartridges are arranged not in the scanning portion but in a body casing of the printer in a stationary state.

* * * * *